United States Patent [19]

Frizzell et al.

[11] 4,402,333

[45] Sep. 6, 1983

[54] PAINT ROLLER CLEANING DEVICE

[76] Inventors: Leon E. Frizzell, 119 Margie Dr., Pleasant Hill, Calif. 94523; Joseph C. Frizzell, 221 Palin, Galt, Calif. 95632

[21] Appl. No.: 338,478

[22] Filed: Jan. 11, 1982

[51] Int. Cl.[3] ..... B08B 3/02

[52] U.S. Cl. ..... 134/138; 134/149; 134/172

[58] Field of Search ..... 134/138–139, 134/141, 144, 149, 172, 198

[56] References Cited

U.S. PATENT DOCUMENTS

| | | | |
|---|---|---|---|
| 972,736 | 10/1910 | Tippit | 134/139 |
| 3,075,534 | 1/1963 | Habostad | 134/138 |
| 3,577,280 | 5/1971 | George | 134/138 |
| 3,587,599 | 6/1971 | Bywater | 134/149 |
| 3,688,785 | 9/1972 | Stevens et al. | 134/149 |
| 3,897,797 | 8/1975 | Wright et al. | 134/138 X |

*Primary Examiner*—Robert L. Bleutge

*Attorney, Agent, or Firm*—Manfred M. Warren; Robert B. Chickering; Glen R. Grunewald

[57] ABSTRACT

A device for cleaning a paint roller which includes a cylindrical cylinder in which the roller may be suspended while it is still attached to its operating handle, and a nozzle fixed to direct a stream of water against the roller in a non-radial direction to wash paint from the roller while at the same time causing it to rotate on its axis to expel water and paint centrifugally.

10 Claims, 6 Drawing Figures

PAINT ROLLER CLEANING DEVICE

BACKGROUND OF THE INVENTION

Paint rollers to apply paint to flat surfaces such as the walls and ceilings of rooms have become very popular. Paint can be applied very rapidly with a roller and paint so applied has a very professional appearance. A problem with employing a roller to apply paint is that paint soaks entirely through the nap on the roller and it is very difficult to remove. Cleaning a paint roller involves a great deal of cleaning liquid and a great deal of time because a roller must be washed for a long period of time in order for the paint to run through the nap from the exterior toward the cylindrical interior of the roller and then down the interior of the roller and off the bottom where it can be washed down a drain or into a can. In addition to taking a long time, cleaning a paint roller is a messy job.

SUMMARY OF THE INVENTION

This invention is a device for cleaning a paint roller that is clean, easy to use and effective to remove all of the paint from the roller very quickly. The device of this invention includes a cylindrical casing that has an inside diameter greater than the outside diameter of the paint roller with which it is to be used. The cylindrical casing has an open bottom and an open top, although in a preferred embodiment a lid to close the top after the paint roller is inserted into the device is provided. Throughout this specification various elements of the device of this invention will be referred to in terms of "upper" and "lower" and it is to be understood that the upper and lower orientations of the device are as it would be in normal use.

Although a preferred embodiment of the invention is to have the casing cylindrical the invention would function adequately with the equivalent of a cylindrical casing, for example, one with a hexagonal or octagonal cross section. The casing is made of material such as 4 inch rigid plastic pipe although other materials having equivalent structural properties may be used.

The casing is provided with means to hold a paint roller on its operating handle so that the roller is coaxial with the casing. When so held the paint roller is free to rotate inside of the casing as will be explained more fully hereinafter. Although any suitable means may be employed to hold the roller coaxial with the casing a very efficient and inexpensive means includes a notch cut into the top edge of the casing that is slightly wider than the wire element of the operating handle so that the roller may be placed within the casing with the wire portion engaged in the notch. On the exterior of the casing there is provided a releaseable means to hold some other portion of the operating handle assembly so that the operating handle assembly is held at 2 space points, one at the notch and one at the releaseable means whereby it can be positioned and firmly maintained so that the roller is within the casing and approximately coaxial with it.

The casing has an elongated spot through its side which is elongated in a direction parallel with the long axis of the casing. The elongated slot preferably is as long as the paint roller to be cleaned. The elongated slot is surrounded with a housing that contains a nozzle. The housing is adapted to contain the nozzle within it but to permit the nozzle to move up and down in the housing a distance substantially equal to the length of the slot.

The nozzle is held within the housing not only to be moveable upwardly and downwardly, but to direct a flow of fluid through the slot and into the casing in a direction that is not radial with respect to the circular cross section of the casing.

Finally, the device of this invention includes means associated with the nozzle for providing fluid to it. In its most common sense the nozzle will have means on it that will connect it to a ordinary garden hose although a circulating system including a pump and a sump may be employed to use the device with a solvent for oil base paints.

BRIEF DESCRIPTION OF THE DRAWINGS

A preferred embodiment of the invention will be described with reference to the accompanying drawings.

DETAILED DESCRIPTION OF THE INVENTION

Figure 1:
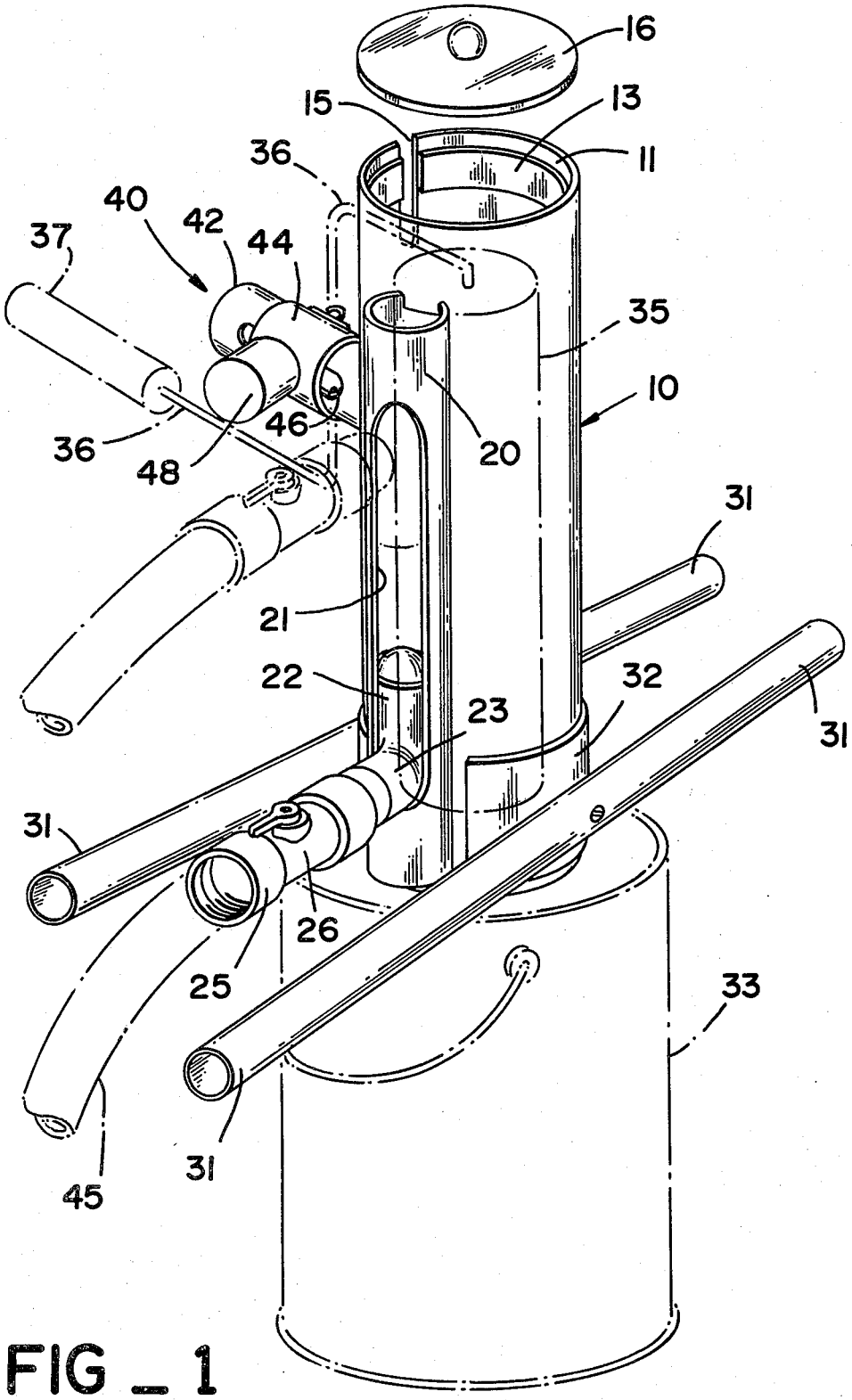
FIG. 1 is a perspective view of a device embodying this invention shown with a phantom line representation of a paint roller installed within it and a waste water can positioned beneath it.

The device embodying this invention that is illustrated in FIG. 1 has a casing generally designated 10 which is preferably a large diameter piece of pipe, such as rigid plastic pipe. The casing 10 is cylindrical in cross section and it has an open top 11 and an open bottom 12. In the embodiment illustrated the top is provided with an internal collar 13 and a notch 15. The internal collar 13 acts as a stop to prevent a lid 16 from entering the interior of housing 10 any farther than the upper surface of collar 13. Notch 15 is adapted to receive the wire handle element of a paint roller to position the paint roller vertically within the interior of casing 10 when it is being cleaned.

Casing 10 also is provided with an elongated slot 17 that runs from almost the top of the casing 10 to almost its bottom.

The slot 17 is bridged with a housing 20 which has an elongated opening 21 through its side. A nozzle generally designated 22 rides in housing 20 and is verticaly moveable by access through the opening 21. The nozzle 22 is smaller in diameter than housing 20 but larger in diameter than the opening 21 so that it can readily be moved within housing 20 but cannot be displaced outwardly through the opening 21 by the water pressure. It is preferable, however, that housing 20 be formed of a resilient plastic material so that it can be flexed to permit nozzle 22 to be snapped in and out through opening 21 to allow mounting or removal of the nozzle from the housing.

Nozzle 22 has means to supply it with water shown as the neck 23 which passes through the opening 21 and is provided with means such as a hose connection 25 to connect nozzle 22 with a source of water. In a preferred embodiment the nozzle assembly includes a valve 26 between the hose connection and the nozzle so that the flow of water through the nozzle can be controlled and shut off during the operation of the device.

Figure 4:
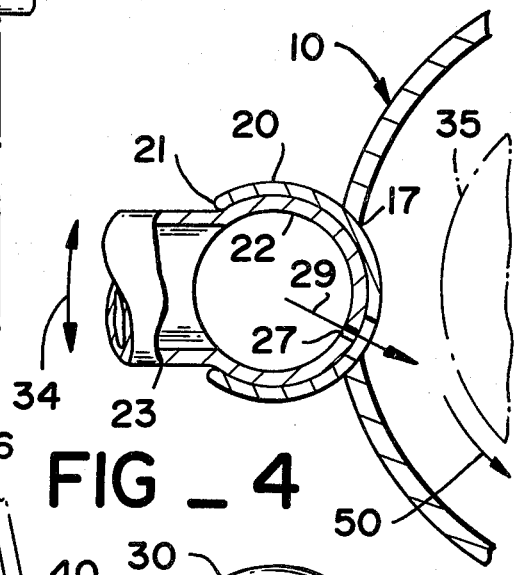
FIG. 4 is an enlarged, cross section view of that portion of the device illustrated in FIG. 1 that constitutes the housing and nozzle.
Figure 6:
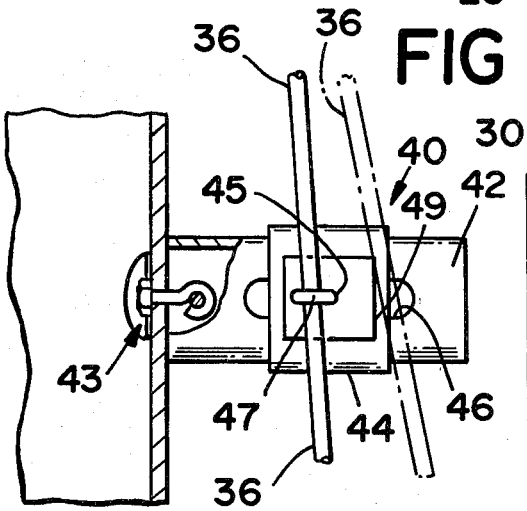
FIG. 6 is a side elevational view in cross section of the handle clamp portion of the device illustrated in FIG. 1.
Figure 5:
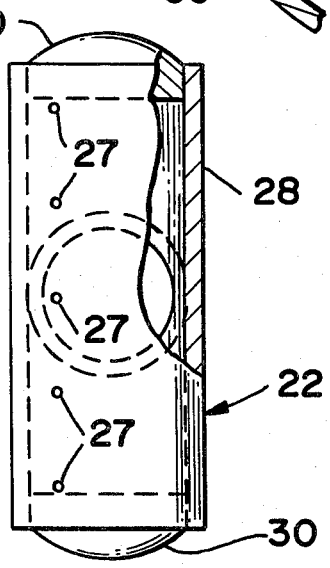
FIG. 5 is an enlarged view partly in cross section of a nozzle useful in the device of this invention.

The neck 23 not only provides a source of liquid to the nozzle but it also orients the nozzle with respect to rotating around its vertical axis, which is an important feature of the device of this invention. The nozzle discharge passageways 27 are oriented to discharge liquid in the direction of arrow 29 shown in FIG. 4, which is not radial to the cross section of cylindrical housing 10. In a preferred embodiment the extension of the line of direction of the flow of the liquid coming from the nozzle will intersect a cross section of a paint roller positioned within the device of this invention on a chord that is closer to a tangent than to a diameter, as illustrated in FIG. 4. Slot 21 is preferably enough larger than neck 23 to permit angular displacement of the nozzle by about 10 to 20 degrees, as indicated by arrow 34. This inturn allows variation of the direction of flow of the stream of liquid so that it can be directed against roller element 35 at a range of angles which enhance cleaning and accommodate rollers of various diameters. The nozzle 22 is preferably made of plastic material. It can be fabricated from a piece of plastic pipe 28 having end caps 30 welded or glued within it.

Figure 2:
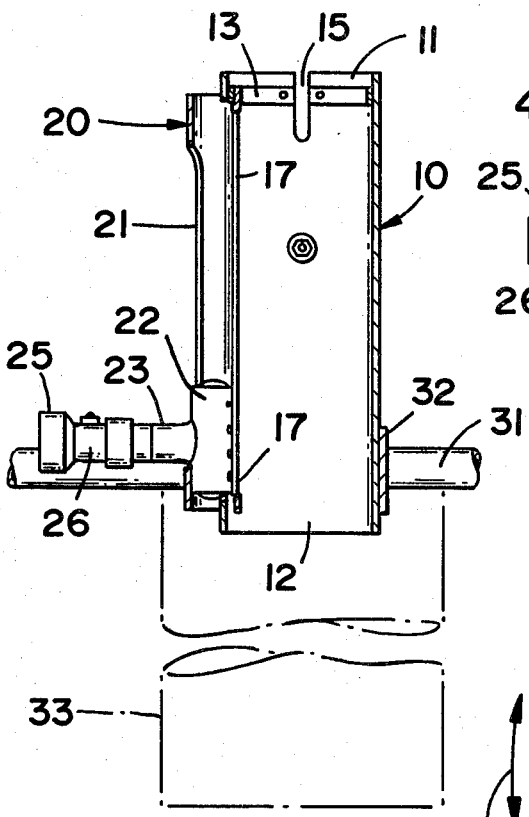
FIG. 2 is a sectional elevation view of the device illustrated in FIG. 1.

In a particularly preferred embodiment of the invention bars 31 are connected to a partial cylindrical clamp 32 which is in the form of a springy plastic or metal partial cylinder. By separating the open wall portion of clamp 32 its grip on casing 10 may be released so that casing 10 can be easily removed. However, if the clamp 32 is opened, casing 32 is inserted, and force holding the rods 31 apart is released, clamp 32 will tightly grasp the exterior wall of casing 10 and hold it frictionally so that it may be positioned, as illustrated in FIG. 1 and FIG. 2, above a container such as paint can 33. All of bars 31 and clamp 32 may be made of rigid plastic pipe of suitable diameter and length.

The device of this invention also includes means to hold a paint roller in the proper position for being cleaned. The paint roller is illustrated in broken line representation and it includes a roller element that is employed to apply paint illustrated at 35, and the usual bent wire handle element 36 which terminates in a wooden or plastic hand grasping portion 37. The device employs two points to secure the position of the roller 35. One point is the bottom of the notch 15, which generally orients the roller 35 vertically within housing 10, and the other point is handle clamp means 40, which orients the roller 35 about a horizontal axis within casing 10.

Figure 3:
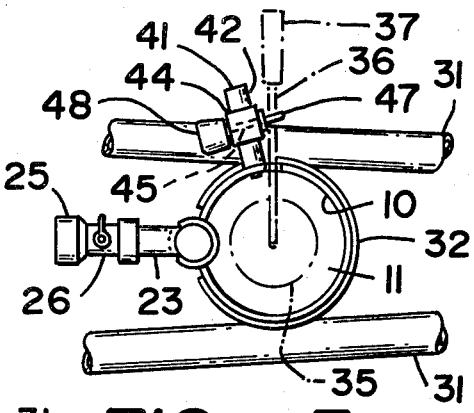
FIG. 3 is a plan view of the device illustrated in FIG. 1.

Handle clamp means 40 preferably is formed as a tubular member 41 secured by fastener means 43 to the side of casing 10 proximate and below slot 15. As best may be seen in FIG. 3, member 41 is secured to casing 10 so that side 42 is substantially aligned with slot 15. Reciprocally mounted to member 41 is a slide member 44, and extending through slots 46 in opposite sides of tubular member 41 is a bolt having a hooked end 47 dimensioned for receipt of roller wire handle 36. The clamp means further includes a cinching knob 48 mounted on a threaded end of bolt 45 and formed to bear against slide member 44.

In operation knob 48 is loosened to enable manipulation of hook 47 around wire handle 36. Slots 46 allow reciprocation of slide 44 axially along the slots to enable clamping at various radial distances from casing 10 to accommodate various handle configurations, as indicated by the hand wire shown in phantom. Additionally, slot 46 has a width dimension which allows rotation of slide 44 about a horizontal longitudinal axis of member 42, which further facilitates clamping or handles 36 of different configurations. Finally, hook 47 can be rotated about the longitudinal axis of bolt 45 (a horizontal axis substantially tangentially oriented with respect to casing 10) to combine with the other adjustment features to provide a clamping structure which is highly and rapidly adjustable. Alternatively, handle clamp 40 may be formed as a pair of opposed springy metal members (not shown) cantilevered outwardly from casing 10 so that they may be moved toward and away from each other by a threaded element or bolt and a wing nut to effect clamping of handle wire 36.

To use the device of this invention a soiled paint roller 35 is positioned within casing 10 by first removing the lid 16, then placing the appropriate portion of the wire handle assembly within notch 15 until the wire handle assembly reaches the bottom of the notch and rests there. At that point a portion of the wire handle element is placed within handle clamp 40, the paint roller is adjusted to be approximately vertical and approximately coaxial with casing 10, and the knob 48 is tightened down to firmly clamp wire handle 36 in that position. The hand grasping portion 37 of the handle assembly will protrude from the device of this invention to a position where it does not interfere with the operation of the device.

When the roller 35 is properly positioned lid 16 is replaced and a source of water under pressure is activated to supply water to hose 45. Normally valve 26 will be closed while water is supplied to hose 45. The casing clamp 32 is then installed, if waste water is to be collected in can 33, or the open bottom 12 of casing 10 can be placed over a drain. At that point valve 26 is opened and water discharges through nozzle holes 27, through the elongated slot in 17 and strikes paint roller 35 nonradially, as best illustrated in FIG. 4.

The nonradial impingement of water against roller 35 causes it to rotate in the direction illustrated by arrow 50 in FIG. 4 and, if water impinges against the roller for even a short time the rate of rotation becomes quite fast so that centrifugal force causes water to be thrown off the roller toward the interior surface of casing 10. Thus, although the initial impingement of water against the roller causes it to penetrate the nap deeply, all the way to the hard cylindrical core, the rapid rotational motion of the roller causes the water to come out of the roller and the overall flow of water is that it penetrates the roller to the core on first impingement and then flows outwardly being flung off of the roller by centrifugal force.

As a result, there is a very effective and efficient cleansing action caused by water flowing from the core of the roller toward its exterior and carrying paint with it. The nozzle is moved up and down in the housing 20, preferably starting the cleaning action from the top with the nozzle in the position as shown in broken lines in FIG. 1 and slowly moving it downwardly toward the position shown in solid lines in FIG. 1. By this method of cleaning recontamination of clean portions of the roller due to gravity is prevented. Although the lid 16 is provided to prevent escape of water through the top of the casing 10, the lid can be removed to observe the cleaning action or it can be made of transparent material so that the progress of the roller cleaning process can be observed. When the roller is clean it may also be observed that water free of entrained paint flows from the bottom opening 12. When the roller is clean valve 26 is closed, lid 16 is removed, handle clamp 40 is released and the clean roller is removed from casing 10. The roller may be left in casing 10 when cleaning is finished to give it time to drain or even time to dry before it is removed.

What is claimed is:

1. A paint roller cleaning device comprising:

a. a cylindrical casing large enough in diameter to surround a paint roller, said casing having an open bottom, an open top, and an elongated slot in the wall thereof said slot having a long axis parallel to the long axis of said casing;

b. means to suspend a paint roller within said casing to be out of contact with the interior wall of said casing and to have the axis of rotation of said paint roller parallel to the long axis of said casing;

c. a housing mounted on the exterior of said casing to bridge said slot;

d. a nozzle moveable within said housing in a direction parallel with the axis of said casing, said nozzle positioned to direct a stream of fluid through said slot in a direction that is not radial with respect to said casing; and e. means to provide liquid to said nozzle.

2. The device of claim 1 wherein said means to suspend a paint roller includes a notch intersecting the top edge of said casing and dimensioned to receive a metal wire portion of a roller handle assembly.

3. The device of claim 2 having a handle clamp exterior of said casing and adapted to releasably hold a wire portion of a roller handle assembly.

4. The device of claim 3 wherein said handle clamp is formed for clamping of said roller handle assembly at selected one of a range of radial distances from said casing.

5. The device of claim 4 wherein said handle clamp is formed for clamping of said handle assembly at a selected one or a range of angular orientations with respect to a horizontal axis tangential to said casing.

6. The device of claim 5 wherein said handle clamp is formed for clamping of said handle assembly at a selected one of a range of angular orientations with respect to a horizontal axis perpendicular to said casing.

7. The device of claim 1 having a valve on said hose connection.

8. The device of claim 1 having support bars on the lower portion of said casing, said support bars being elongated in a plane perpendicular to the axis of said casing.

9. The device of claim 8 wherein said support bars are releasably connected to said casing.

10. The device of claim 9 wherein said support bars are mounted on a friction clamp adapted to frictionally embrace said casing.

* * * * *